US008246766B2

(12) United States Patent
Yokoyama et al.

(10) Patent No.: US 8,246,766 B2
(45) Date of Patent: Aug. 21, 2012

(54) HIGH-STRENGTH NI-BASED ALLOY TUBE FOR NUCLEAR POWER USE AND METHOD FOR MANUFACTURING THE SAME

(75) Inventors: Tetsuo Yokoyama, Sanda (JP); Hiroyuki Anada, Nishinomiya (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 17 days.

(21) Appl. No.: 12/993,838

(22) Filed: Nov. 20, 2010

(65) Prior Publication Data

US 2011/0183151 A1 Jul. 28, 2011

Related U.S. Application Data

(63) Continuation of application No. PCT/JP2009/059249, filed on May 20, 2009.

(30) Foreign Application Priority Data

May 22, 2008 (JP) ..... 2008-134549

(51) Int. Cl.
*C22F 1/10* (2006.01)
*C22C 19/05* (2006.01)

(52) U.S. Cl. ..... 148/556; 148/428

(58) Field of Classification Search ..... 148/677, 148/556, 428
See application file for complete search history.

(56) References Cited

U.S. PATENT DOCUMENTS 5,378,427 A * 1/1995 Otsuka et al. ..... 420/586.1

FOREIGN PATENT DOCUMENTS

| | | |
|---|---|---|
| JP | 58-067854 | 4/1983 |
| JP | 60-245773 | 12/1985 |
| JP | 61-069938 | 4/1986 |
| JP | 62-167836 | 7/1987 |
| JP | 01-132731 | 5/1989 |
| JP | 04-198444 | 7/1992 |
| JP | 06-074475 | 9/1994 |
| JP | 2004-218076 | 8/2004 |
| JP | 2007-224372 | 9/2007 |

OTHER PUBLICATIONS

English Translation of Yamanaka et al. (JP 60-245773) (1985).*

* cited by examiner

*Primary Examiner* — Jessee R. Roe
(74) *Attorney, Agent, or Firm* — Clark & Brody

(57) ABSTRACT

The high-strength Ni-based alloy tube for nuclear power use consists, by mass percent, of C: 0.04% or less, Si: 0.10 to 0.50%, Mn: 0.05 to 0.50%, Ni: 55 to 70%, Cr: more than 26% and not more than 35%, Al: 0.005 to 0.5%, N: 0.02 to 0.10%, and one or more kinds of Ti: 0.01 to 0.5% and Nb: 0.02 to 1.0%, the balance being Fe and impurities. For this alloy tube, the grain size is as fine as grain size No. 6 or higher in JIS G 0551. It is preferable that the high-strength Ni-based alloy tube be manufactured by the process of preparing a Ni-based alloy stock through a remelting process, hot forging, heating to 1000 to 1160° C., hot extruding at a working ratio such that an extrusion ratio is 4 or higher, and performing solution annealing and thermal treatment.

1 Claim, No Drawings

HIGH-STRENGTH NI-BASED ALLOY TUBE FOR NUCLEAR POWER USE AND METHOD FOR MANUFACTURING THE SAME

TECHNICAL FIELD

The present invention relates to a Ni-based alloy tube excellent in corrosion resistance in a high-temperature and pressure water environment of a nuclear power plant and a method for manufacturing the same. More particularly, the invention relates to a Ni-based alloy tube suitable for a structural member such as a penetration nozzle of a reactor vessel of a pressurized water reactor (PWR) and a method for manufacturing the same.

BACKGROUND ART

Since a structural member of a reactor vessel is required to have corrosion resistance such as stress corrosion cracking resistance in a high-temperature and pressure water environment, a Ni-based alloy excellent in corrosion resistance, Inconel 600 (15%Cr-75%Ni) or Inconel 690 (30%Cr-60%Ni), has been used.

To further improve the corrosion resistance of these Ni-based alloys, various techniques described below have been proposed.

For example, Patent Documents 1 and 2 disclose a Ni-based alloy in which the stress corrosion cracking resistance is improved by carrying out final annealing at a regulated heating temperature and holding time after extruding and cold working Patent Document 3 discloses a Ni-based alloy in which the grain boundary damage resistance is improved by forming an amorphous alloy layer coated on the surface layer to remove grain boundaries. Patent Document 4 discloses a high-strength Ni-based alloy in which the stress corrosion cracking resistance is improved by forming a micro-structure where $M_{23}C_6$ is precipitated preferentially in a semi-continuous form at grain boundaries by containing at least one of a γ' phase and a γ" phase in a y matrix. Patent Document 5 discloses a Ni-based alloy in which the intergranular corrosion resistance, intergranular stress corrosion cracking resistance, and mechanical strength in a weld heat affected zone are improved by properly balancing the contents of components of C, N, and Nb. Patent Document 6 discloses a Ni-based alloy in which the intergranular stress corrosion cracking resistance is improved by forming a micro-structure where the low angle boundary ratio at grain boundaries is 4% or more.

Citation List

[Patent Document]

[Patent Document 1] JP60-245773A

[Patent Document 2] JP58-67854A

[Patent Document 3] JP61-69938A

[Patent Document 4] JP62-167836A

[Patent Document 5] JP1-132731A

[Patent Document 6] JP2004-218076A

SUMMARY OF INVENTION

Technical Problem

As described above, many proposals for improvement in corrosion resistance of Ni-based alloy tube have been made. For the Ni-based alloy tube, variations in grain size and strength increase as a result of solution annealing and the subsequent thermal treatment for precipitating carbides, so that in some cases, strength decreases in a tube end part or the like. Therefore, in some cases, a defective portion must be cut off inevitably, which poses a problem of lowered yield.

The present invention has been made to solve the above problem, and accordingly an objective thereof is to provide a high-strength Ni-based alloy tube for nuclear power use having uniform high temperature strength throughout the overall length of tube and a method for manufacturing the same.

Solution to Problem

The present inventors conducted various studies and experiments on the causes for improvement in high temperature strength of a high-strength Ni-based alloy tube for nuclear power use, and resultantly obtained findings of the following items (a) to (j).

(a) In order to improve the high temperature strength of a high-strength Ni-based alloy tube for nuclear power use, Ti and Nb should be contained. Ti and Nb combine with C and N to precipitate carbo-nitrides effective at making grain fine.

(b) As the heating temperature before hot extruding, a temperature is preferable at which grain are not coarsened, and though Cr carbo-nitride is solution treated, carbo-nitrides of Ti or Nb effective at making grain fine is not solution treated.

(c) In order to obtain fine grain, not only the extruding temperature in hot extruding should be regulated but also the working ratio should be increased.

(d) When Cr segregation exists in a source material to be hot extruded, the complete solution temperatures of Cr carbo-nitrides are different locally, so that Cr carbo-nitrides precipitate locally. The local precipitation of Cr carbo-nitrides results in local obstruction of precipitation of carbo-nitrides of Ti or Nb. Therefore, when Cr segregation exists in a source material to be hot extruded, even if Ti and Nb are contained, a location in which the precipitation of carbo-nitrides of Ti or Nb is obstructed takes place, so that uniform refinement of grain cannot be achieved.

(e) Further, when the segregation of Ti, Nb, C or N exists, similarly, carbo-nitrides of Ti or Nb do not precipitate uniformly, so that a micro-structure in which fine grain are dispersed uniformly cannot be obtained.

(f) That is, in order to improve the high temperature strength uniformly throughout the overall length of the high-strength Ni-based alloy tube for nuclear power use, carbo-nitrides of Ti or Nb are to be dispersedly precipitated by controlling heating temperature before hot extruding and working ratio at the time of hot extruding, while not only Ti and Nb are contained but also segregation of elements constituting the Ni-based alloy tube is restrained. As the target value of grain size of the high-strength Ni-based alloy tube for nuclear power use, fine grain of grain size No. 6 or higher in JIS G 0551 are demanded.

(g) As a method for restraining the segregation of elements constituting the Ni-based alloy tube, a remelting process using, for example, an electroslag remelting (ESR) process or a vacuum arc remelting (VAR) process can be used. When the electroslag remelting (ESR) process is applied, the average melting speed thereof should preferably be made 200 to 600 kg/hr. At a speed exceeding 600 kg/hr, the floating of impurities at the time of melting is insufficient, and therefore the restraint of segregation may become insufficient. Also, at a speed lower than 200 kg/hr, the productivity is too low.

(h) As for the conditions of heating temperature before hot extruding and working ratio at the time of hot extruding, it is preferable that a Ni-based alloy stock obtained by the remelting process using the electro slag remelting (ESR) process or the vacuum arc remelting (VAR) process be hot forged and thereafter heated to 1000 to 1160° C., and then be hot extruded at a working ratio such that the extrusion ratio is 4 or higher. The extrusion ratio is defined as a ratio of the cross-sectional area before extruding to the cross-sectional area after extruding.

The reason of setting the upper limit of heating temperature before hot extruding at 1160° C. is to use a temperature at which Cr carbo-nitrides is solution treated, and carbo-nitrides of Ti or Nb is not solution treated. The reason why the lower limit of heating temperature before hot extruding at 1000° C. is that at a temperature lower than 1000° C., the deformation resistance at the time of hot extruding is too large. The reason why the working ratio of hot extruding is preferably made 4 or higher in extrusion ratio is that at this working ratio, sufficient working and therefore uniform recrystallization can be achieved, resulting in sufficiently fine grain. More preferably, the extrusion ratio is 5 or higher. The upper limit of the extrusion ratio is not especially specified. However, since as the extrusion ratio increases, defects such as flaws are liable to occur on the product, and the equipment must be increased in size, the extrusion ratio is preferably set at 30 or lower.

(i) After hot extruding, solution annealing and thermal treatment should be performed.

An objective of solution annealing is to sufficiently dissolve carbides therein to be solution treated. The heating temperature for this purpose is preferably set at 980 to 1200° C. The heating temperature of 980° C. or higher may improve the corrosion resistance because carbides can be sufficiently dissolved to be solution treated. On the other hand, the heating temperature exceeding 1200° C. may deteriorate the strength due to coarsened grains. Further preferable upper limit of the heating temperature is 1090° C.

An objective of thermal treatment is to precipitate carbides at grain boundaries. The heating temperature for this purpose is preferably set at 550 to 850° C. If heating is performed in this temperature range, carbides can be precipitated sufficiently at grain boundaries.

When it is desired to obtain a small-diameter Ni-based alloy tube, solution annealing and thermal treatment are preferably performed after cold drawing and cold rolling have been performed after hot extruding.

(j) Regarding the target values of high temperature strength of the Ni-based alloy tube for nuclear power use in accordance with the present invention, for example, the design yield strength at 350° C. specified in Codes for Nuclear Power Generation Facility JSME S NC-1 is 199 MPa, and the design tensile strength is 530 MPa. To attain these target values, the grain size of the high-strength Ni-based alloy tube for nuclear power use after solution annealing and thermal treatment is required to be as fine as grain size No. 6 or higher in JIS G 0551.

The present invention was completed on the basis of the above-described findings, and the gists thereof are a high-strength Ni-based alloy tube for nuclear power use and a method for manufacturing the same.

(1) A high-strength Ni-based alloy tube for nuclear power use consisting, by mass percent, of C: 0.04% or less, Si: 0.10 to 0.50%, Mn: 0.05 to 0.50%, Ni: 55 to 70%, Cr: more than 26% and not more than 35%, Al: 0.005 to 0.5%, N: 0.02 to 0.10%, and one or more kinds of Ti: 0.01 to 0.5% and Nb: 0.02 to 1.0%, the balance being Fe and impurities, wherein the grain size is as fine as grain size No. 6 or higher in JIS G 0551.

(2) A high-strength Ni-based alloy tube for nuclear power use according to the above item (1), wherein a Ni-based alloy stock is obtained by a remelting process.

(3) A method for manufacturing a high-strength Ni-based alloy tube for nuclear power use, comprising preparing a Ni-based alloy stock, through a remelting process, that consists, by mass percent, of C: 0.04% or less, Si: 0.10 to 0.50%, Mn: 0.05 to 0.50%, Ni: 55 to 70%, Cr: more than 26% and not more than 35%, Al: 0.005 to 0.5%, N: 0.02 to 0.10%, and one or more kinds of Ti: 0.01 to 0.5% and Nb: 0.02 to 1.0%, the balance being Fe and impurities, hot forging, heating to 1000 to 1160° C., hot extruding at a working ratio such that an extrusion ratio is 4 or higher, and performing solution annealing and thermal treatment.

Advantageous Effects of Invention

The present invention can provide a high-strength Ni-based alloy tube for nuclear power use, which has uniform high temperature strength throughout the overall length of tube and a method for manufacturing the same.

[Embodiment to Execute the Invention]

Hereunder, a chemical composition constituting the high-strength Ni-based alloy tube for nuclear power use in accordance with the present invention and reasons for restricting the contents of the components are explained. In the following description, "%" relating to the content means "mass %".

C: 0.04% or less

C (Carbon) is an element necessary for securing strength. However, if the content exceeds 0.04%, Cr carbides increase, and the stress corrosion cracking resistance decreases. Therefore, the upper limit of C content was set at 0.04%. The preferable upper limit is 0.03% or less. In the case where the strength is secured by containing C, 0.01% or more of C is preferably contained.

Si: 0.10 to 0.50%

Si (Silicon) is an element used as a deoxidizer. To achieve this effect, 0.10% or more of Si must be contained. On the other hand, if the Si content exceeds 0.50%, the weldability is deteriorated, and the degree of cleanliness is lowered. Therefore, the Si content was made 0.10 to 0.50%. The preferable Si content is 0.22 to 0.45%.

Mn: 0.05 to 0.50%

Mn (Manganese) is an element that has an effect of improving the hot extruding workability by fixing S, which is an impurity, as MnS, and is also effective as a deoxidizer. To secure the hot extruding workability of alloy, 0.05% or more of Mn must be contained. On the other hand, if excessive Mn exceeding 0.50% is contained, the degree of cleanness of the alloy is lowered. Therefore, the Mn content was made 0.05 to 0.50%.

Ni: 55 to 70%

Ni (Nickel) is an element effective at securing the corrosion resistance of alloy. In particular, Ni performs remarkable action for improving the acid resistance and the intergranular stress corrosion cracking resistance in chlorine ion-containing high temperature water, so that 55% or more of Ni must be contained. On the other hand, the upper limit of Ni content is 70% in relationship with the necessary content of other elements of Cr, Mn, Si, and the like. Therefore, the Ni content must be 55 to 70%. The preferable Ni content range is more than 58% and not more than 65%. The further preferable Ni content range is more than 60% and not more than 65%.

Cr: more than 26% and not more than 35%

Cr (Chromium) is an element necessary for maintaining the corrosion resistance of the alloy. To secure the required corrosion resistance, the Cr content must exceed 26%. On the other hand, if the Cr content exceeds 35%, the hot extruding workability is deteriorated remarkably. Therefore, the Cr content must be more than 26% and not more than 35%. The preferable Cr content is more than 27% and not more than 32%, and the further preferable Cr content is 28 to 31%.

Al: 0.005 to 0.5%

Al (Aluminum) is an element acting as a deoxidizer like Si, and therefore 0.005% or more of Al must be contained. On the other hand, if the Al content exceeds 0.5%, the degree of cleanliness of the alloy is lowered, so that the Al content was made not more than 0.5%. The preferable Al content is 0.02 to 0.3%.

N: 0.02 to 0.10%

N (Nitrogen) forms carbo-nitrides of Ti or Nb together with C to enhance the strength of the alloy. Also, in the present invention, in combination with the segregation restraining effect of N, C, Ti and Nb due to the remelting process, these carbo-nitrides can be dispersedly precipitated uniformly to provide fine grain in the micro-structure after hot extruding. To achieve this effect, 0.02% or more of N must be contained. On the other hand, if the N content exceeds 0.10%, nitrides increase excessively, so that the hot extruding workability and the ductility are inversely deteriorated. Therefore, the N content was made 0.02 to 0.10%. The preferable N content is 0.03 to 0.06%.

One or more kinds of Ti: 0.01 to 0.5% and Nb: 0.02 to 1.0%

Ti (Titanium) performs action for enhancing the strength of the alloy by forming carbo-nitrides and for improving the hot extruding workability. To achieve these effects, 0.01% or more of Ti must be contained. On the other hand, if the Ti content exceeds 0.5%, not only the effects saturate, but also the ductility is impaired by the production of intermetallic compounds. Therefore, the Ti content was made 0.01 to 0.5%. The preferable Ti content is 0.05 to 0.3%.

Nb (Niobium) performs, like Ti, action for enhancing the strength of the alloy by forming carbo-nitrides and for improving the hot extruding workability. To achieve these effects, 0.02% or more of Nb must be contained. On the other hand, if the Nb content exceeds 1.0%, not only the effects saturate, but also the ductility is impaired by the production of intermetallic compounds. Therefore, the Nb content was made 0.02 to 1.0%. The preferable Nb content is 0.1 to 0.6%.

EXAMPLE 1

A Ni-based alloy having a chemical composition given in Table 1 was melted in an electric furnace, and thereafter was refined by AOD and VOD. Subsequently, the alloy was remelted by ESR at a melting average speed of 500 kg/hr to obtain a Ni-based alloy stock. After being heated at 1270° C. and hot forged at a forging ratio of 5, the alloy stock was worked into a billet for hot extrusion. After the billet had been heated by varying the heating temperature, the billet was hot extruded at an extrusion ratio of 5 to obtain a Ni-based alloy tube having an outer diameter of 115 mm and a wall thickness of 27.5 mm. The alloy tube was subjected to solution annealing of 1075° C.×30 min and thermal treatment of 700° C.×900 min to obtain a final product. For comparison, for a Ni-based alloy stock for which remelting using ESR was omitted, a final product was obtained in the same way.

TABLE 1

| | Chemical composition (mass %. the balance: Fe and impurities) | | | | | | | | |
|---|---|---|---|---|---|---|---|---|---|
| Alloy No. | C | Si | Mn | Ni | Cr | Al | N | Ti | Nb |
| 1 | 0.02 | 0.24 | 0.28 | 59 | 30 | 0.08 | 0.03 | 0.21 | — |
| 2 | 0.02 | 0.25 | 0.28 | 60 | 30 | 0.10 | 0.03 | — | 0.45 |

Table 2 gives whether or not the remelting process was performed using an ESR process and the various heating temperatures before hot extruding.

TABLE 2

| | | | | | Tensile test at high temperature (350° C.) | | | |
|---|---|---|---|---|---|---|---|---|
| Alloy No | Remelting Process ESR | Heating temperature (° C.) before hot extruding | Extrusion ratio | Average grain size number | Yield strength (MPa) | Tensile strength (MPa) | Elongation (%) | Result (*) |
| 1 | Performed | 1100° C. | 5 | 7 5 | 240 | 580 | 47 | ○ |
| | | 1150° C. | 5 | 6 7 | 225 | 575 | 49 | ○ |
| | | 1200° C. | 5 | 5 2 | 198 | 530 | 50 | x |
| | Not performed | 1150° C. | 5 | 5 7 | 195 | 537 | 53 | x |
| | | 1200° C. | 5 | 4 2 | 186 | 515 | 51 | x |
| 2 | Performed | 1100° C. | 5 | 7 7 | 243 | 582 | 45 | ○ |
| | | 1150° C. | 5 | 6 8 | 228 | 577 | 47 | ○ |
| | | 1200° C. | 5 | 5 4 | 198 | 533 | 50 | x |
| | Not performed | 1150° C. | 5 | 5 6 | 196 | 539 | 50 | x |
| | | 1200° C. | 5 | 4 5 | 188 | 518 | 50 | x |

(*) Note:

○: Both of yield strength and tensile strength were attained to the targets. 199 MPa and 530 MPa. respectively.

x: Either of yield strength and tensile strength was not attained to the targets above.

A specimen for measuring grain size and a tensile test specimen were sampled from a position 150 mm distant from the tube end of the obtained Ni-based alloy tube, and a grain size test conforming to JIS G 0551 and a tensile test at 350° C. conforming to JIS G 0567 were conducted. The test results are additionally given to Table 2.

The test results given in Table 2 revealed that by the use of the remelting process using an ESR process and the proper selection of heating temperature before hot extruding, a Ni-based alloy in which the micro-structure is fine and the strength at a high temperature (350° C.) is high can be obtained.

[Industrial Applicability]

As described above, the present invention can provide a high-strength Ni-based alloy tube for nuclear power use, which has uniform high temperature strength throughout the overall length of tube and a method for manufacturing the same.

The invention claimed is:

1. A method for manufacturing a high-strength Ni-based alloy tube for nuclear power use, comprising preparing a Ni-based alloy stock, through a remelting process, that consists, by mass percent, of C: 0.04% or less, Si: 0.10 to 0.50%, Mn: 0.05 to 0.50%, Ni: 55 to 70%, Cr: more than 26% and not more than 35%, Al: 0.005 to 0.5%, N: 0.02 to 0.10%, and one or more kinds of Ti: 0.01 to 0.5% and Nb: 0.02 to 1.0%, the balance being Fe and impurities, hot forging, heating to 1000 to 1160° C., hot extruding at a working ratio such that an extrusion ratio is 4 or higher, and performing solution annealing and thermal treatment.

* * * * *